United States Patent [19]

Engel

[11] Patent Number: 5,060,399

[45] Date of Patent: Oct. 29, 1991

[54] DRYER HAVING LOADING ON BOTH SIDES

[76] Inventor: Gerhard Engel, Weststtr. 12, 7129 Gueglingen, Fed. Rep. of Germany

[21] Appl. No.: 562,579

[22] Filed: Aug. 3, 1990

[30] Foreign Application Priority Data

Aug. 5, 1989 [DE] Fed. Rep. of Germany ..... 3925976

[51] Int. Cl.[5] ..... F26B 11/02

[52] U.S. Cl. ..... 34/133; 34/236

[58] Field of Search ..... 34/10, 15, 22, 92, 133, 34/236

[56] References Cited

U.S. PATENT DOCUMENTS

| | | | |
|---|---|---|---|
| 3,208,800 | 9/1965 | Boon | 302/17 |
| 3,400,467 | 9/1968 | Drace | 34/133 |
| 4,285,219 | 8/1981 | Grunewald | 34/236 |
| 4,467,530 | 8/1984 | Fesmire et al. | 34/236 |
| 4,509,275 | 4/1985 | Coffman et al. | 34/236 |
| 4,726,125 | 2/1988 | Pellerin | 34/133 |

FOREIGN PATENT DOCUMENTS

| | | |
|---|---|---|
| 1915990 | 10/1979 | Fed. Rep. of Germany . |
| 3419743 | 11/1985 | Fed. Rep. of Germany . |

*Primary Examiner*—Henry A. Bennett
*Assistant Examiner*—Denise L. F. Gromada
*Attorney, Agent, or Firm*—Foley & Lardner

[57] ABSTRACT

A dryer has suction loading on both sides to save space and to allow washed materials to be loaded into the dryer from plural spaces at different levels without the need for any additional conveying equipment. The dryer comprises first and second flexible tubes and a suction fan for drawing the washed materials from loading stations, through the first and second flexible tubes, and into the drum of the dryer. A flap is inserted in each flexible tube to selectively connect the drum as well as the fan to the respective loading station during loading, and to seal the respective connections during drying. The flaps may be either mechanically or automatically actuated.

14 Claims, 4 Drawing Sheets

DRYER HAVING LOADING ON BOTH SIDES

BACKGROUND OF THE INVENTION

The invention relates to a dryer having suction loading on both sides for drying out liquids from textiles, formed fabrics, felts, hides, and other water bound materials, and in particular for draining items of washing.

More particularly, the invention relates to a dryer having a frame, a drum, a fan, a heating unit, and a tilting device. In various technological processes, conforming with the newly developed machines, such as presses and centrifuges, and increasing automation of washing units, the drying operation has to take place in the shortest possible cycle times with optimum residual moisture of the washing.

In order to avoid the manual loading of the dryer, transport belts, lifting belts or monorail systems have been used. However, these loading systems take up a lot of space and are only rarely capable of being installed in existing spaces.

SUMMARY OF THE INVENTION

Therefore, the underlying object of the invention is to develop a dryer having a loading system taking up minimum space, in which case the energy consumption is not to be higher in comparison with the loading systems known hitherto.

According to one aspect of the invention, the dryer includes a frame, a drum rotatably mounted on the frame, and a drive device for rotating the drum. The dryer further includes a flexible tube connected in an air-tight manner to the dryer and opening into a loading station where the wet materials are stored. A suction fan is adapted to draw the materials out of the loading station and into the dyer drum. A first suction flap is adapted to selectively seal the flexible tube after loading so that the wet materials can be effectively dried.

The dryer may further comprise a second flexible tube connected to a loading slide of the dryer and opening into another loading station to allow loading from loading stations located on different levels from one another. This second flexible tube is also selectively closed via a second suction flap cooperating therewith.

The suction flaps, as well as air flaps operable to close suction openings on the dryer, may be either mechanically or automatically operated.

According to another aspect of the invention, a dryer comprises, in addition to a frame and a drum rotatably mounted on the frame and rotated by a drive means, a flexible tube connected in an airtight manner to the dryer and opening into a loading station where the wet materials are stored. A suction fan means is adapted to draw the materials out of the loading station and into the dryer drum. Means are provided for selectively sealing the flexible tube so as to isolate the loading station from the dryer drum.

The sealing means preferably comprises a flap.

The dryer may further comprise a second flexible tube leading from a loading slide of the dryer to a second loading station. Means are provided for selectively sealing the second flexible tube, which sealing means preferably comprises a second flap.

Another object of the invention is to provide a method for drying materials that are initially located in loading stations.

The method consists of initially turning on a fan to create a suction force within a dryer. A suction flap which seals a flexible tube connecting the dryer to a loading station is then opened. The suction force created by the fan then draws the materials out of the loading station, through the flexible tube, and into the dryer. The suction flap is then closed, the materials are dried and are subsequently removed from the dryer.

The loading step may further comprise the step of opening a second suction flap so that materials are drawn from a second container, through a second flexible tube, and into the dryer. The second suction flap is then closed and the drying step is commenced.

BREIF DESCRIPTION OF THE DRAWINGS

Some examples of the invention are illustrated in the enclosed drawings, in which:

FIG. 1 shows a dryer having suction loading on one side and a loading and unloading door on the opposite side, FIG. 2 shows the dryer as in FIG. 1, but during unloading, FIG. 3 shows a dryer having suction loading on both sides and a loading and unloading door on one side, FIG. 4 shows a front view of FIG. 1, FIG. 5 shows the dryer of FIG. 1 during the drying operation.

DETAILED DESCRIPTION OF THE PREFERRED EMBODIMENTS

Figure 1:
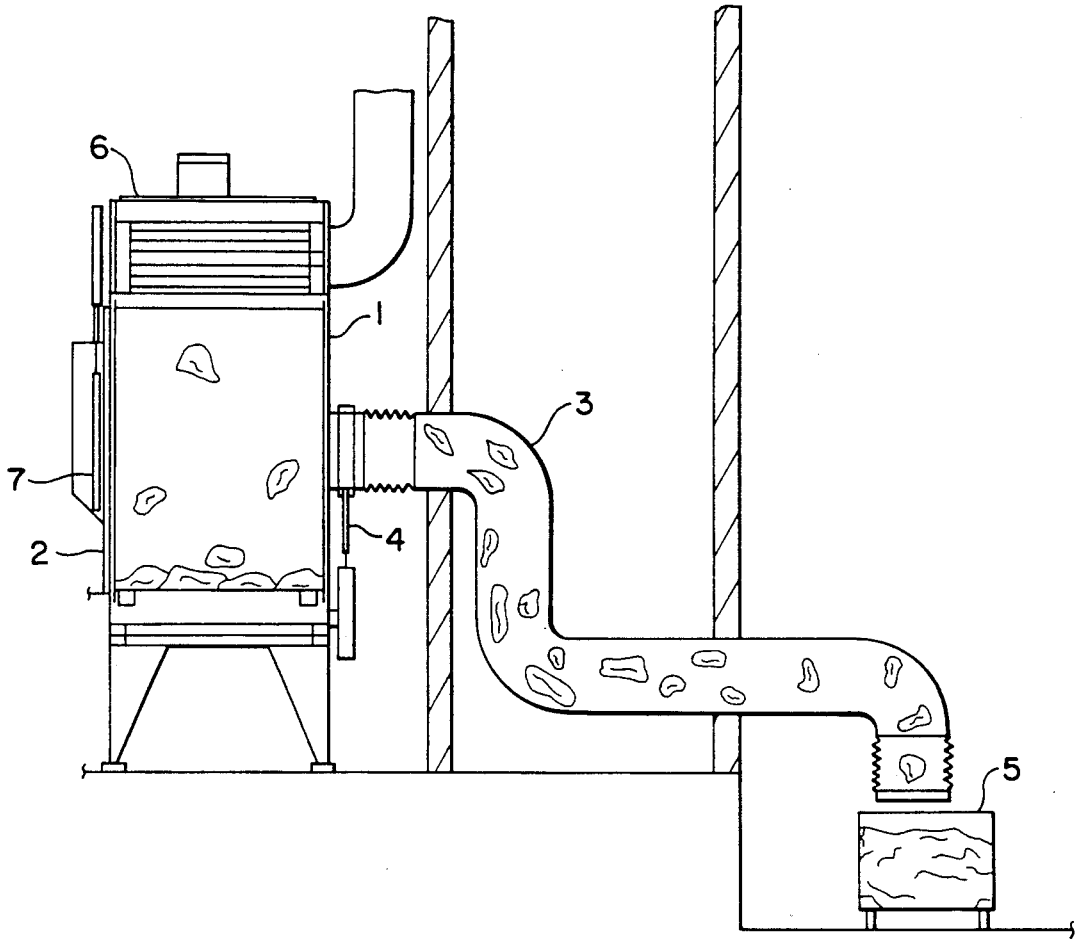

The object is achieved by the invention of the dryer having suction loading on both sides. This type of loading not only enables the necessary space requirement to be reduced to the optimum minimum, but also—an extremely important factor—the washing can be loaded into the dryer from other spaces at different levels without additional conveying equipment. Additionally, the energy requirement for the suction loading of the dryer is significantly lower in comparison with the loading systems known hitherto since the suction fan is always in operation with each loading operation.

FIGS. 1, 2, 4 and 5 illustrate a dryer having suction loading on one side, in which a flexible tube or hose 3 is attached airtightly to the loading side 1 of the dryer.

The dryer 1 consists of a conventional frame 11, a tilting device 12, a drum 13 rotated by a drive 14, a suction fan 15, and a heating unit 16 which cooperate in a known manner to dry materials such as textiles, hides, etc. The flexible tube 3 connected to dryer 1 also has an inlet capable of being inserted into a loading station. A closable suction flap 4 cooperates with the hose 3 and seals the hose from the dryer when closed. Air flaps 6 are provided for closing suction openings of the dryer 1. The suction flap 4 and the air flaps 6 are operated either mechanically or automatically in conjunction with the cycle times of the suction loading and with the drying operation. An unloading door 2 and a loading slide 7 allow access to the dryer for the side opposite hose 3. The illustration shows the dryer in the suction loading phase, the suction flap 4 being open and the air flaps 6 of the suction openings and the unloading door 2 and the loading slide 7 being closed.

Figure 5:
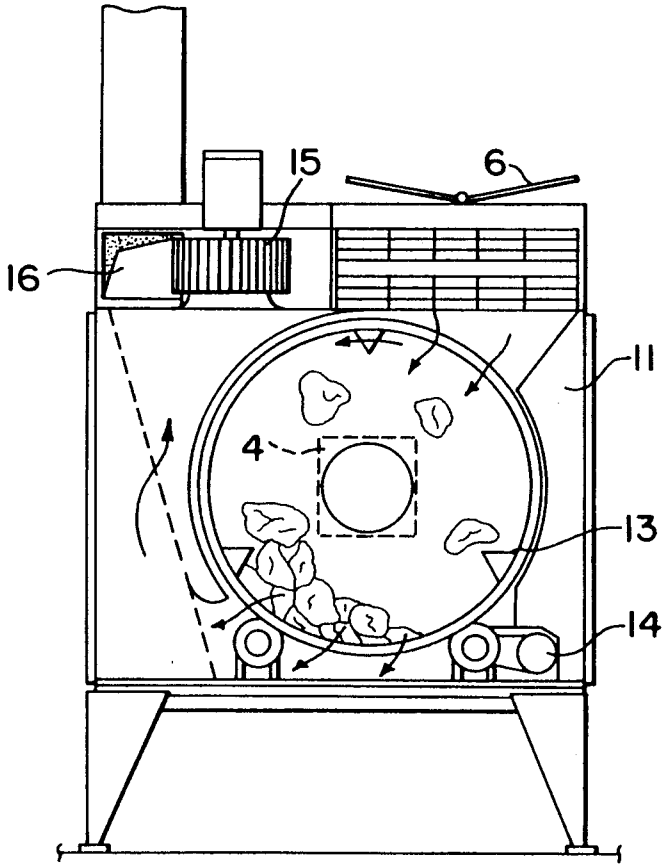
Figure 4:
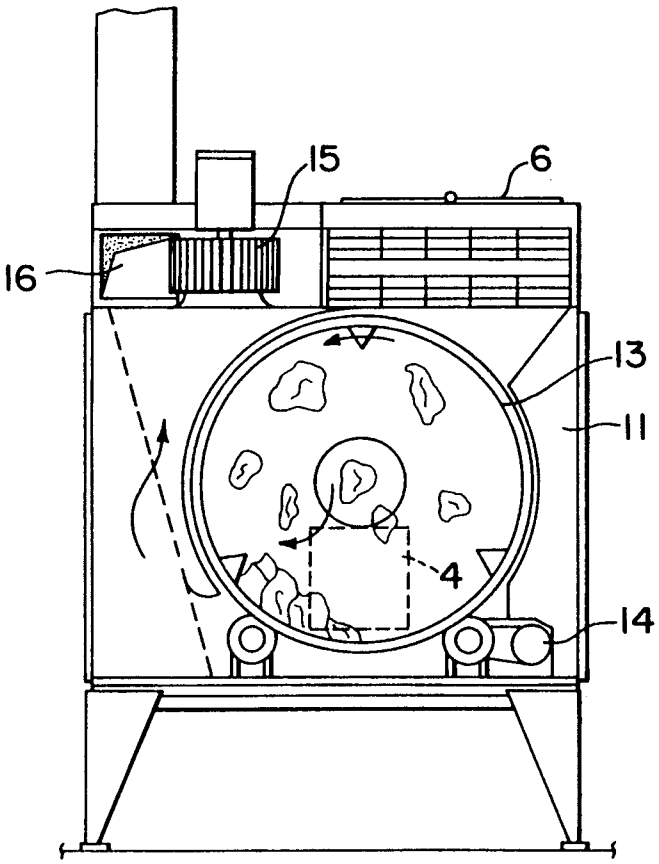

In operation, the air fan produces low pressure in the flexible tube 3, by which means the washing is sucked from the loading station 5 into the dryer. This suction operation is illustrated in FIG. 1 and FIG. 4. On completion of the suction operation, the suction flap 4 is closed and the air flaps 6 are opened and the drying operation, which is illustrated in FIG. 5, begins.

Figure 2:
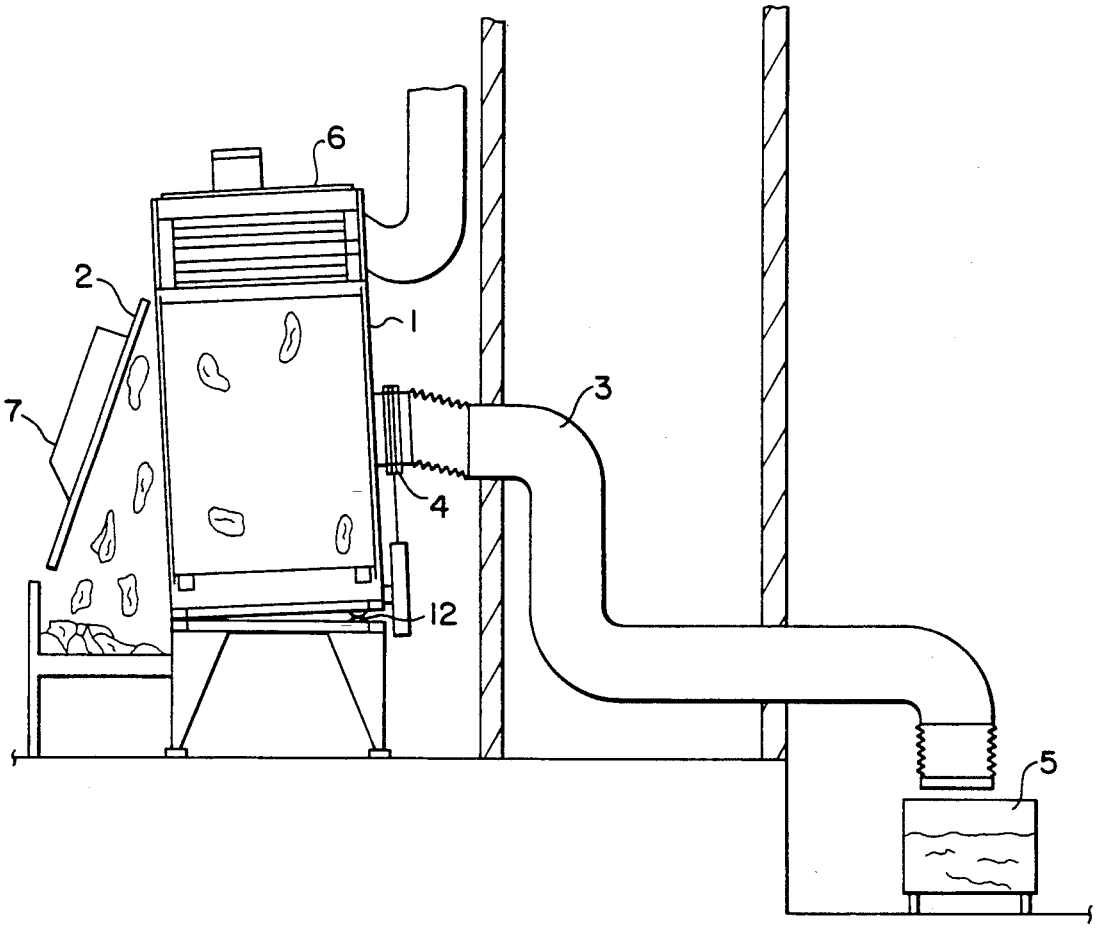

During unloading—FIG. 2—the suction fan 14 is switched off, the unloading door 2 is opened and the dried washing falls out of the dryer which has been inclined by the tilting device.

If the loading station 5 is not provided with washing on time or not provided with sufficient washing, it is possible to load the dryer through the opening in the loading slide 7 with the unloading door 2 and the suction flap 4 closed. After the opening in the loading slide 7 has been closed, the drying and unloading operation proceeds according to the illustration in FIG. 5 and FIG. 2.

Figure 3:
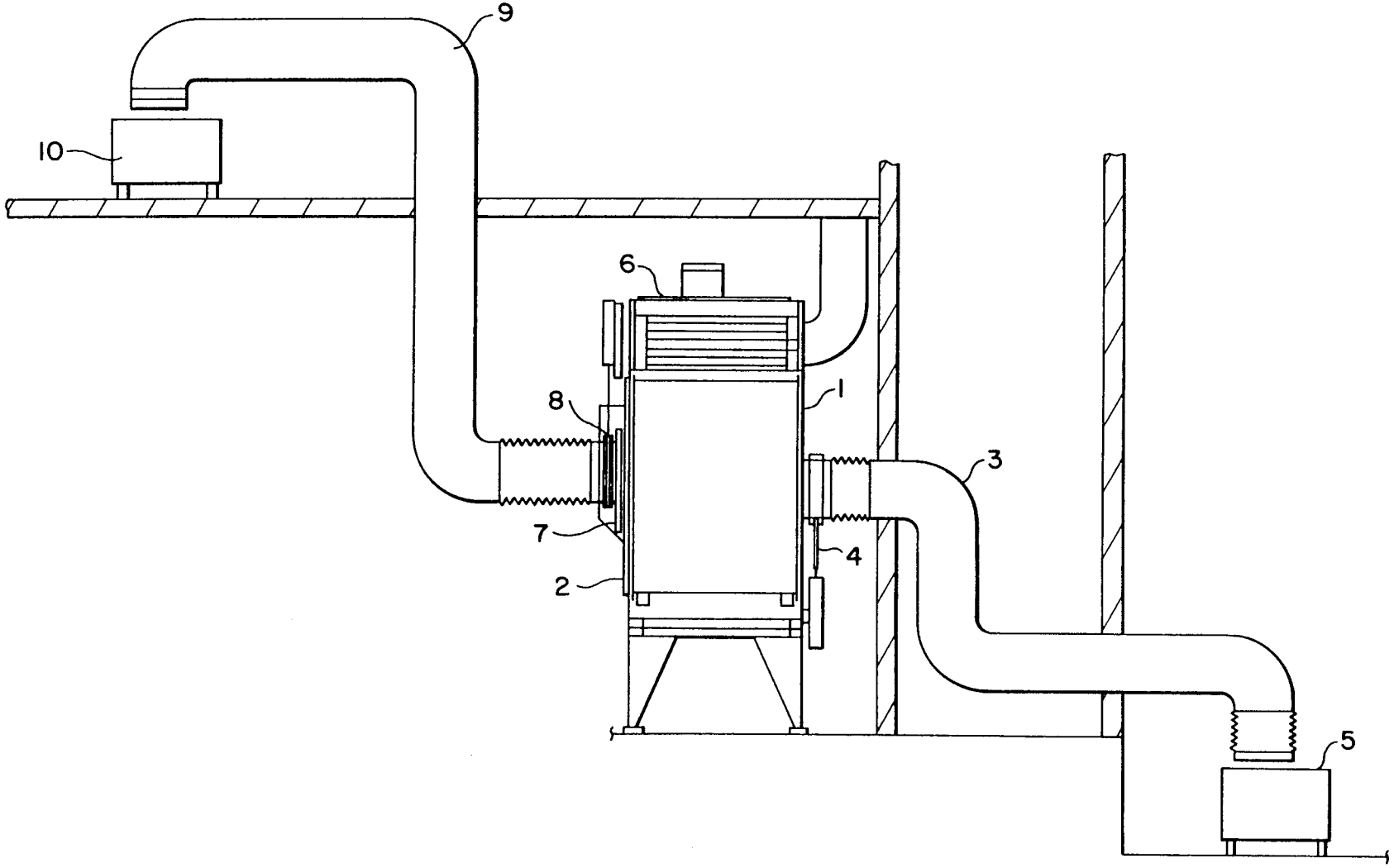

FIG. 3 illustrates a dryer having suction loading on both sides.

The dryer of FIG. 3 has, in addition to the elements of the dryer of FIGS. 1, 2, 4, and 5, a second flexible tube or hose 9 extending from a second loading station 10 to the loading slide 7 of dryer 1. The second flexible tube 9 is attached in an air-tight manner to the loading slide 7. A second closable suction flap 8 cooperates with flexible tube 9, and seals the tube 10 from the dryer 1 when closed. The suction flap 8, like the flaps 4 and 6, is operated either mechanically or automatically in conjunction with the cycle times of the suction loading and with the drying operation.

The flexible tubes 3, 9 enable the loading to take place alternately from the loading stations 5, 10 which can be accommodated in spaces at different levels. FIG. 3 illustrates the suction loading from the loading station 5, the suction flap 4 in the flexible tube 3 which is mounted airtightly on the loading side 1 of the dryer, being opened and the air flaps 6 as well as the unloading door 2 and the suction flap 8 in the flexible tube 9 being closed. If the washing is to be sucked from the loading station 10, the suction flap 8 in the flexible tube 9 is opened with the unloading door 2 closed and, at the same time, the air flaps 6 and the suction flap 4 are closed. During the drying operation, the air flaps 6 are opened and, at the same time, the suction flaps 4 and 8 are closed. The unloading takes place through the unloading door 2 as illustrated in FIG. 2, the flexible tube 9 remaining attached to the loading slide 7 even during the unloading.

I claim:

1. A dryer for drying materials initially located in loading stations comprising:

(a) a frame having suction openings formed therein;
(b) a drum rotatably mounted on said frame;
(c) drive means for rotating said drum;
(d) a first flexible tube attached in an air-tight manner to said dryer and opening into said drum and into one of said loading stations;
(e) suction fan means for drawing materials into said drum from said loading station through said flexible tube;
(f) a first suction flap adapted to selectively seal said first flexible tube; and
(g) air flaps adapted to selectively close said suction openings.

2. The dryer of claim 1, wherein said flexible tube is connected to a loading side of said dryer.

3. The dryer of claim 2, further comprising a loading slide attached to said dryer, a second flexible tube connected to said loading slide in an air-tight manner, and a second suction flap adapted to selectively seal said second flexible tube, wherein said suction fan means draws materials from another of said loading stations into said drum through said second flexible tube.

4. The dryer of claim 3, wherein said first and second suction flaps and said air flaps are operated mechanically in conjunction with cycle times of the suction loading of said dryer and with dryer operation.

5. The dryer of claim 3, wherein said first and second suction flaps and said air flaps are operated automatically in conjunction with cycle times of the suction loading of said dryer and with dryer operation.

6. A dryer for drying materials initially located in loading stations, comprising:

(a) a frame;
(b) a drum rotatably mounted on said frame;
(c) drive means for rotatably said drum;
(d) a first flexible tube attached in an air-tight manner to said dryer and opening into said drum and into one of said loading stations;
(e) a suction fan means for drawing materials into said drum from said one loading station through said first flexible tube;
(f) first sealing means for selectively sealing said first flexible tube so as to isolate said loading station from said suction fan means and from said drum; and
(g) a loading slide attached to said dryer, a second flexible tube connected to said loading slide in an air-tight manner, and a second sealing means for selectively sealing said second flexible tube so as to isolate said suction fan means and said drum from antoehr of loading stations.

7. The dryer of claim 6, wherein said first and second sealing means comprise first and second flaps.

8. The dryer of claim 7, wherein said first and second flaps are operated automatically in conjunction with cycle times of the suction loading of said dryer and with dryer operation.

9. The dryer of claim 7, wherein said first and second flaps operated mechanically in conjunction with cycle times of the suction loading of dryer and with dryer operation.

10. A method of drying materials that are initially located in loading stations comprising the steps of:

(a) turning on a suction fan to create a suction within a drum of a dryer;
(b) loading said dryer by opening a first suction flap provided in a first flexible tube connecting said drum to one of said loading stations, whereby the suction force created by said suction fan draws materials out of said one loading station, through said second flexible tube, and into said drum;
(c) closing said first suction flap to isolate said drum from said loading station;
(d) drying said materials; and
(e) removing said materials from said dryer.

11. The method of claim 10, wherein said step of loading said dryer further comprises the step of opening a second suction flap provided in a second flexible tube connected to another of said loading stations, whereby said suction force created by said suction fan draws materials out of said another loading station, through said second flexible tube, and into said drum.

12. The method of claim 10, further comprising the step of closing said second suction flap before commencing the drying step to isolate said drum from said another loading station.

13. The method of claim 10, wherein said step of loading said dryer further comprises the step of loading materials into said drum through a loading slide while said first suction flap is closed.

14. The method of claim 10, further comprising the steps of closing air flaps to close suction openings of said dryer before commencing the loading step and subsequently opening said air flaps to open said suction openings before commencing the drying step.

* * * * *